United States Patent [19]

George et al.

[11] Patent Number: 4,487,122

[45] Date of Patent: Dec. 11, 1984

[54] DEFLECTION COMPENSATING ROLL FOR PROVIDING UNIFORM CONTACT PRESSURE

[75] Inventors: Harvey F. George, West Hampstead; Robert H. Oppenheimer, Glen Cove, both of N.Y.

[73] Assignee: Gravure Research Institute, Inc., Port Washington, N.Y.

[21] Appl. No.: 548,640

[22] Filed: Nov. 4, 1983

[51] Int. Cl.[3] ..... B41F 9/00

[52] U.S. Cl. ..... 101/153; 101/216; 29/116 AD; 100/162 B

[58] Field of Search ..... 101/153, 154, 155, 156, 101/157, 212, 216, 218, 219, 247; 26/101, 102, 103, 104; 29/116 R, 116 AD; 100/162 B

[56] References Cited

U.S. PATENT DOCUMENTS

| | | | |
|---|---|---|---|
| 2,651,103 | 9/1953 | Hornbostel | 29/129 X |
| 2,689,392 | 9/1954 | Robertson | 29/116 R |
| 2,730,771 | 1/1956 | Beck et al. | 29/129 X |
| 2,825,217 | 3/1958 | Byrd | 100/162 B |
| 3,097,591 | 7/1963 | Justus | 100/162 B |
| 3,672,018 | 6/1972 | Junk et al. | 29/116 AD |
| 3,885,283 | 5/1975 | Biondetti | 29/116 AD |
| 3,983,811 | 10/1976 | Fuchs et al. | 101/216 |
| 4,354,431 | 10/1982 | Fischer | 101/218 X |
| 4,372,205 | 2/1983 | Pflaum | 29/116 AD |
| 4,438,695 | 3/1984 | Maier et al. | 101/153 |

FOREIGN PATENT DOCUMENTS

| | | | |
|---|---|---|---|
| 1295957 | 4/1969 | Fed. Rep. of Germany | 101/216 |
| 2919479 | 10/1980 | Fed. Rep. of Germany | 101/153 |

*Primary Examiner*—Edgar S. Burr
*Assistant Examiner*—Charles A. Pearson
*Attorney, Agent, or Firm*—Bollo & Drumm

[57] ABSTRACT

A system for compensating for roll deflection to provide uniform contact pressure across the width of a web disposed between a pair of counter rollers, comprising a first roller mounted for rotation, a second roller mounted for rotation about a deflectable shaft, pressure applying means coupled to the ends of the deflectable shaft for moving the second roller into contact with the first roller, the second roller including an outer shell mounted for rotation relative to the deflectable shaft, a pair of end bearings disposed adjacent the ends of the outer sleeve and a pair of main bearings disposed inwardly from the end bearings a predetermined distance to transmit the applied pressure uniformly over the face width of the second roller when the second roller is used with a flexible first roller, and self-adjusting deflection compensating means arranged proximate to the deflectable shaft for applying pressure to the ends of the outer shell in response to the deflection of the deflectable shaft by the pressure applying means to provide uniform pressure across the face width of the second roller when the second roller is used with a first roller having a high resistance to bending.

39 Claims, 5 Drawing Figures

DEFLECTION COMPENSATING ROLL FOR PROVIDING UNIFORM CONTACT PRESSURE

BACKGROUND OF THE INVENTION

The present invention relates to a deflection compensating roll for arrangement parallel to a counter roll, and more particularly to a deflection compensating impression roll disposed parallel to a gravure cylinder in a gravure press.

In many printing, coating or laminating operations, where it is desired to pass a web or several webs between two rollers, it is essential that the pressure exerted by the rollers against the web is uniform across the width of the web. Similarly, when printing ink is distributed by passing between a roller having a metal surface and a roller having an elastomeric covering, it is advantageous that the contact pressure between the rollers be uniform across the width of the rollers. Even if the rollers are of proper cylindrical shape, and their bearings are properly aligned, uneven contact pressure can result from the bending deflection of one or both of the rollers due to the contact pressure.

In rotogravure printing, small cells representing the image to be printed are etched or engraved in the surface of the gravure cylinder. In those areas of the gravure cylinder where print-out is required, there may be approximately 10,000 to 40,000 cells per square inch. In those areas where a dark tone is to be printed, the cells are deeper and/or of greater surface area then in those areas where a light tone is to be printed.

In a conventional gravure press, the gravure cylinder is rotated around its horizontal axis with its lower surface immersed in a fountain containing liquid ink. Rotation of the cylinder carries the ink flooded portion of the cylinder out of the fountain and passes it under a doctor blade whose edge engages the surface of the cylinder and removes the ink that is clinging to the surface of the gravure cylinder, leaving only the ink that is located in the cells.

The print-out or transfer of the ink that remains in the cells to a printing substrate, which may be a web of paper, paper board, glassine, metal foil, film, or a laminate of the above materials, is accomplished by pressing the substrate web into contact with the inked and doctored portion of the rotating gravure cylinder by means of an elastomeric covered impression roll which rotates around a horizontal axis arranged parallel to the axis of the gravure cylinder.

The impression roll includes a tubular steel impression roll core covered with an elastomeric covering. The elastomeric covering is generally made from such materials as natural or synthetic rubbers filled with carbon black or zinc oxide, polyurethane, or similar materials. The elastomeric coverings are typically from 0.375 to 0.750 inches thick and have a hardness of 75 to 95 Shore A Durometer. Softer coverings are generally used on smooth foil and film, where low impression pressures are employed.

In order to obtain the optimum print-out across the width of the web and to avoid tears and wrinkles in the web, it is essential that the impression pressure is uniform across the width of the impression roll covering. The deleterious effects of uneven impression pressure are most pronounced when the distance between the center line of the gravure cylinder and the center line of the impression roll differs by more than about 0.003 to about 0.007 inches across the width of the impression roll covering.

The forces that are applied to the impression roll to press the substrate against the gravure cylinder and thus cause the ink to transfer to the substrate are adjusted in accordance with the hardness and roughness of the side of the printing substrate that is printed, i.e., harder and rougher substrates require higher impression pressures. Paper, such as that used in magazines and catalogs is typically printed at impression pressures of about 40 to about 80 pli (pounds per linear inch of impression roll covering face width).

For gravure presses which print webs up to about 50 inches wide, impression rolls which have outside diameters of up to about 9 inches are sufficiently stiff so that the effects of uneven impression pressure due to bending of the impression roll core are minor. On presses which use wider webs, bending of the impression roll can cause poor printout near the center of the web because of insufficient impression pressure, as well as damage to the impression roll covering and wrinkles and tears in the web.

For wide presses, the conventional practice has been to place a heavy steel back-up cylinder, e.g., 12 inches in diameter, on top of and in pressure contact with the impression roll. The impression pressure is developed by the dead weight of the back-up cylinder, and the application of forces at the bearing blocks of the back-up cylinder near the side frames of the press. Such an arrangement greatly reduces the bending of the impression roll and is effective up to a point where the maximum web width used with the gravure press is not more than 6 to 7 times the diameter of the gravure cylinder. If the web width for which the gravure press is designed is larger than 6 or 7 times the diameter of the gravure cylinder of if a gravure cylinder of small diameter is used, the deleterious effects of uneven impression pressure due to bending of the gravure cylinder is noticeable.

However, the use of a back-up cylinder also has certain drawbacks. The impression roll covering is compressed twice during each rotation of the impression roll. This increases the press power requirements and causes increased heating of the impression roll covering, thereby shortening its life. Further, the added rotary inertia of the back-up cylinder strains the drive components of the press during acceleration and emergency stops.

In gravure presses, gravure cylinders and impression roll cores are presently proportioned so that an increase in wall thickness will not significantly increase the resistance to elastic bending. Moreover, their diameters cannot be arbitrarily increased because the gravure cylinder circumference must be a simple multiple of the page width or length or the repeat length of the pattern that is printed. Further, with an impression roll having a substantially larger than customary diameter, the impression forces are distributed over too wide an impression flat width thereby reducing the pressure per unit of area in the contact zone between gravure cylinder and impression roll, thus impairing print-out.

In response to the aformentioned problems a number of deflection compensating impression systems that operate without back-up cylinders have been introduced for gravure presses. The NIPCO roll, manufactured by Escher Wyss Ltd. of Zurich, Switzerland, employs a non-rotating beam across the width of the press into which a row of hydraulic cylinders have been incorporated. Associated downward pointing pistons bear against a rotating steel reinforced rubber sleeve, which exerts impression pressure on the web. Controlled leakage of the hydraulic fluid provides lubrication between the stationary pistons and the rotating sleeve, and also provides cooling. Pressure is applied to only that portion of the impression roll in contact with the web.

Other deflection compensating impression systems attempt to apply essentially uniform impression pressure across the entire width of the impression roll face. Such systems are the Bugel roll manufactured by M.A.N. of Augsburg, West Germany; the CDR Controlled Deflection Roll manufactured by the Motter Press Company of York, Pa.; the Flexible Impression Roll manufactured by Componenti Grafici of Lomellina, Italy; and the K2 Roller System manufactured by Albert-Frankenthal AG in Frankenthal, West Germany. All of these systems employ a stationary inner beam and a tubular elastomeric covered rotating metal shell that is supported by ball or roller bearings near its ends. To overcome the effects of impression roll and gravure cylinder bending, downward forces are applied to the inner rings of ball or roller bearings, whose outer races bear against the inner surface of the tubular impression roll core near the center of the impression roll. Except for the CDR roll, the pressure on the bearings near the center of the impression roll is applied by pneumatic or hydraulic means.

With the above systems, the pressure that is applied at the center bearings has to be released by separate, external, manual or automatic means to permit free rotation of the impression roll when the impression roll is lifted off the gravure cylinder for insertion of a new web which occurs at the beginning of the press run or after a web break. Moreover, the pressures that are applied near the roll centers must be readjusted every time the pressures applied to the ends of the impression roll are changed.

Systems have been proposed that eliminate the need for center pressure adjustments and that enable the impression roll shell to turn freely when the impression roll is lifted off of the gravure cylinder to pass a web therebetween at the beginning of the press run or after a web break. In such systems, the roller shell is supported on a stationary beam by two bearings that are located a given distance away from the roller ends towards the center of the press. By methods outlined in the literature, e.g., "Formulas for Stress and Strain", Fifth Edition, by R. J. Roark and W. C. Young, McGraw-Hill, Inc. 1975, International Standard Book Number 0-07-053031-9, it can be demonstrated that the upward deflections at the impression roll center and at its ends are equal under load when the bearings are located at a distance of about 22 percent of the roller face length as measured from the ends of the roller. However, such systems are not satisfactory when the gravure cylinder deflects by more than about 0.003 inches or when gravure cylinders having different diameters and bending stiffness are used on a gravure press.

SUMMARY OF THE INVENTION

It is an object of the present invention to provide a self-adjusting deflection compensating roll for providing uniform pressure contact which does not require readjustment when its contact pressure with a parallel counter roll is changed.

It is a further object of the present invention to provide a self-adjusting deflection compensating roll which is free to rotate when it is separated from pressure contact with a parallel roll.

It is a further object of the present invention to provide a self-adjusting deflection compensating roll which can be used with a number of parallel counter rolls having different bending strengths.

It is a still further object of the present invention to provide a self-adjusting deflection compensating roll which does not require complex hydraulic and pneumatic pressure control means.

It is a still further object of the present invention to provide a self-adjusting deflection compensating roll which advantageously utilizes the natural bending tendency of the components of the roll under load to provide uniform pressure across the face width of the roll.

It is a still further object of the present invention to provide a self-adjusting deflection compensating impression roll which after being set does not require further readjustment whenever the amount of the impression pressure on the gravure cylinder is changed.

It is a still further object of the present invention to provide a self-adjusting deflection compensating impression roll which is free to rotate when it is separated from pressure contact with the gravure cylinder.

It is a still further object of the present invention to provide a self-adjusting deflection compensating impression roll which can be used with a number of gravure cylinders having different bending strengths.

It is a still further object of the present invention to provide a self-adjusting deflection compensating impression roll which does not require complex hydraulic and pneumatic pressure control means.

It is a still further object of the present invention to provide a self-adjusting deflection compensating impression roll which advantageously utilizes the natural bending tendency of the components of the impression roll under load to provide uniform pressure across the face width of the roll.

It is a still further object of the present invention to provide a simple, reliable and economical self-adjusting deflection compensating impression roll.

Briefly, in accordance with the present invention, a system is provided for compensating for roll deflection to provide uniform contact pressure across the width of a web disposed between a pair of counter rollers, comprising a first roller mounted for rotation, a second roller mounted for rotation about a deflectable shaft, pressure applying means coupled to the ends of the deflectable shaft for moving the second roller into contact with the first roller, the second roller including an outer shell mounted for rotation relative to the deflectable shaft, a pair of end bearings disposed adjacent the ends of the outer sleeve and a pair of main bearings disposed inwardly from the end bearings a predetermined distance to transmit the applied pressure uniformly over the face width of the second roller when the second roller is used with a flexible first roller, and self-adjusting deflection compensating means arranged proximate to the deflectable shaft for applying pressure to the ends of the outer shell in response to the deflection of the deflectable shaft by the pressure applying means to provide uniform pressure across the face width of the second roller when the second roller is used with a first roller having a high resistance to bending.

Other objects, aspects and advantages of the present invention will be apparent from the detailed description considered in conjunction with the drawings, as follows:

DETAILED DESCRIPTION

Figure 1:
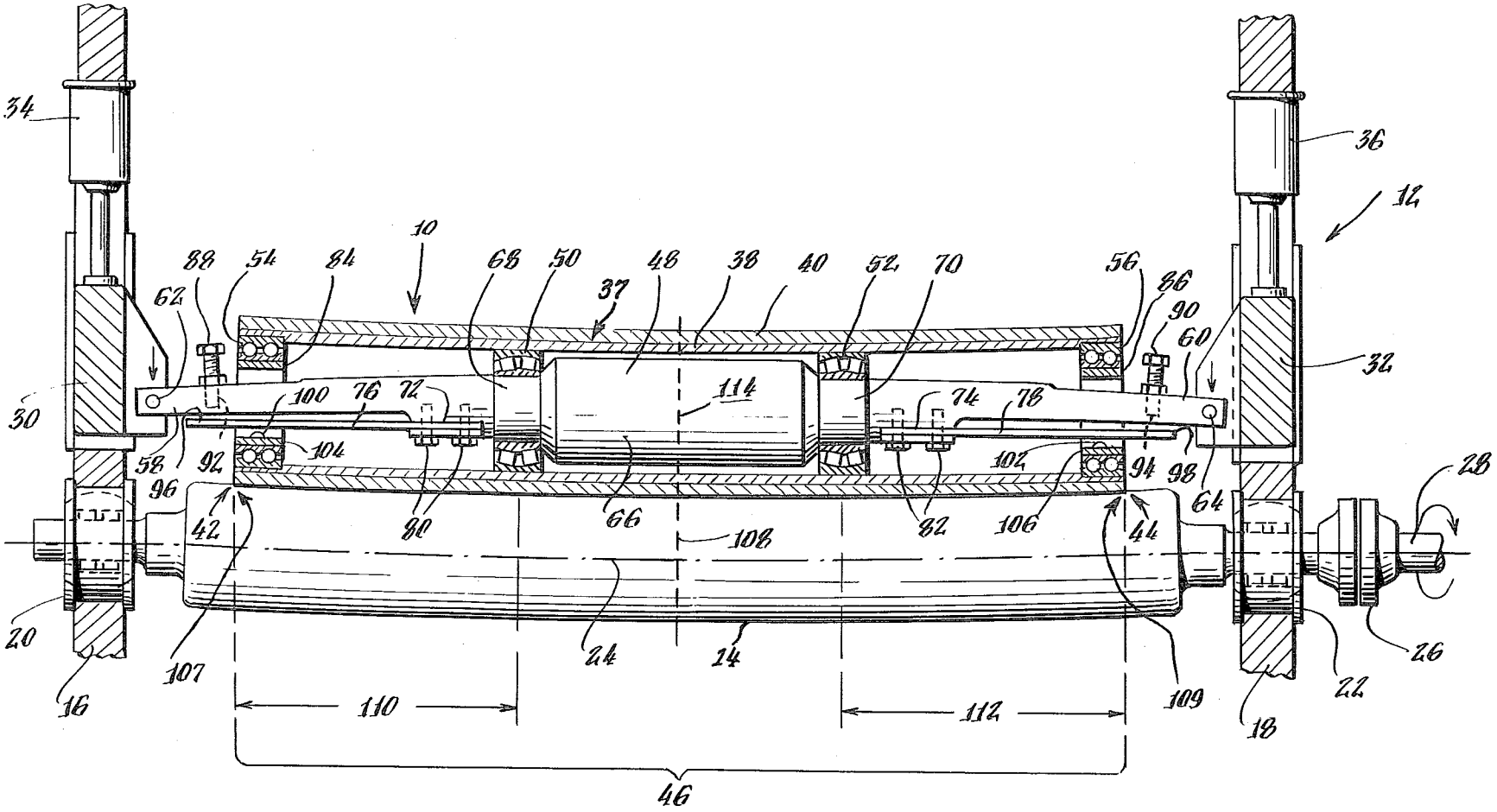
FIG. 1 is a side elevational view in partial section of a deflection compensating impression roll in accordance with the present invention mounted in a gravure press for use with the most flexible gravure cylinder to be used on that press.

Referring to FIG. 1, a deflection compensating impression roll 10 is shown mounted in a gravure press 12 for pressure contact with a gravure cylinder 14. The gravure cylinder 14, as illustrated, is the most flexible gravure cylinder 14 to be used with the press 12. The gravure cylinder 14 is mounted for rotation in side frames 16 and 18 by externally self-aligning roller bearings 20 and 22 and is rotated about its axis 24 by a conventional drive train (not shown) through a flexible coupling 26 which permits a small amount of misalignment between the axis 24 of the gravure cylinder 14 and the output shaft 28 of the drive train.

Positioned at or near the side frames 16 and 18 are mechanical slides 30 and 32 which are raised or lowered by pneumatic cylinders, hydraulic cylinders, or mechanical means 34 and 36, respectively, capable of exerting downward forces in excess of 5,000 lbs. on each side of the press 12. The general arrangement of the slides 30 and 32 and force producing means 34 and 36 is conventional, although the details of construction will differ for different presses.

The impression roll 10 is enlarged in relation to the other components of the press 12 to more clearly illustrate the features of the present invention. The impression roll 10 includes a shell 37 having a tubular metal sleeve 38, having an outside diameter of about 6 to about 10 inches and a wall thickness of about $\frac{3}{8}$ to about $\frac{3}{4}$ inch, over which is bonded a covering 40 of rubber, which may be a semi-conducting rubber or other elastomer. The length of the elastomeric covering 40 from one end 42 to the other end 44 of the impression roll 10 is defined as the face width 46 of the impression roll 10.

The impression roll 10 also includes a non-rotating beam or shaft 48 upon which the shell 37 is supported by a pair of main bearings 50 and 52 and a pair of end bearings 54 and 56. The main bearings 50 and 52 are preferably self-aligning spherical roller bearings and the end bearings 54 and 56 are preferably double row ball bearings. However, it should be understood that other types of anti-friction bearings may be used as long as any misalignment due to bending of the impression roll components does not exceed the bearing specifications.

The ends 58 and 60 of the non-rotating beam 48 are affixed to slides 30 and 32, respectively, e.g., by pins 62 and 64 to move upwardly or downwardly with the slides 30 and 32. The non-rotating beam 48 includes a central portion 66 having a diameter slightly smaller than the inside diameter of the sleeve 38 and reduced diameter portions 68 and 70 onto which the main bearings 50 and 52 are fitted. The reduced diameter portions 68 and 70 also include flat portions 72 and 74, respectively, for affixing leaf springs 76 and 78, respectively, to the non-rotating beam 48. The leaf springs 76 and 78 may be affixed to the beam 48 at one end, e.g., with pairs of threaded bolts 80 and 82, respectively.

The leaf springs 76 and 78 extend laterally outward substantially parallel with the ends 58 and 60 of the non-rotating beam 48 and extend through the central openings of the inner bearing races 84 and 86, respectively, a short distance beyond the ends 42 and 44 of the impression roll 10.

Figure 2:
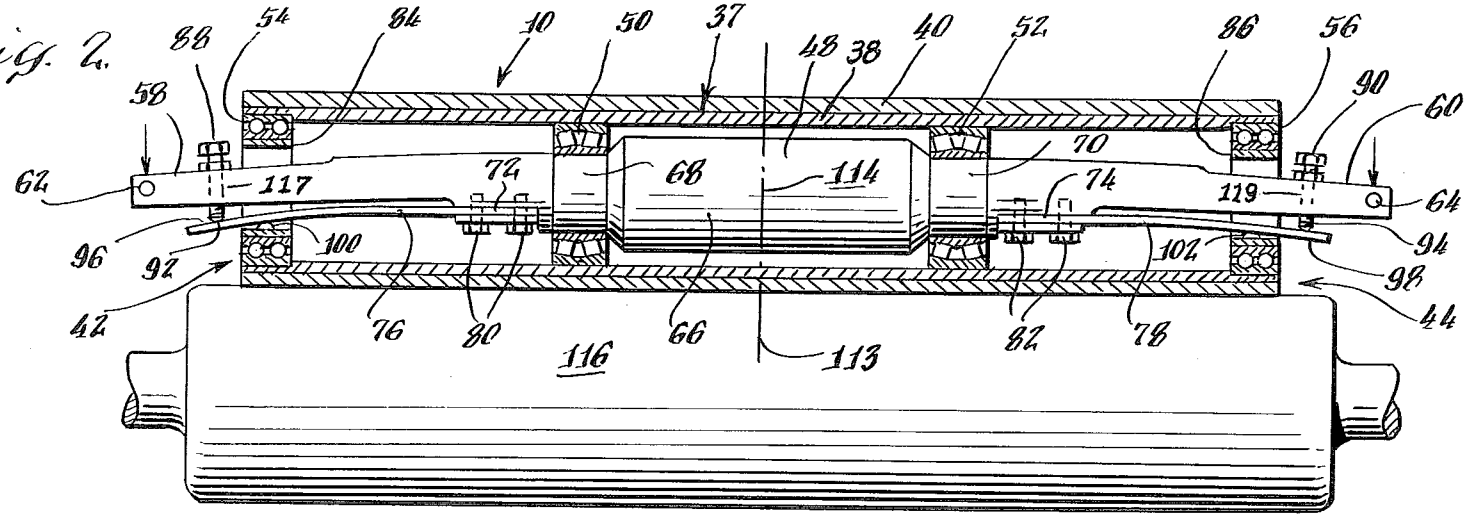
FIG. 2 is a side elevational view in partial section of a deflection compensating impression roll in accordance with the present invention in use with a gravure cylinder of large diameter and high bending strength to be used in a gravure press.

Adjustment screws 88 and 90 mounted in the ends 58 and 60 of the non-rotating beam 48 serve as linkage means and may be turned so that their ends 92 and 94, respectively, engage the remote ends 96 and 98 of leaf springs 76 and 78, respectively, when the ends 92 and 94 extend below the bottom surfaces 96 and 98 of the beam 48, see FIG. 2, thereby causing the downward deflection of the leaf springs 76 and 78 when the ends 58 and 60 of the beam 48 move downwardly a predetermined distance.

Pressure ridges 100 and 102 are affixed to internal pressure quills 104 and 106 of bearings 54 and 56, respectively. The leaf springs 76 and 78 overlie the pressure ridges 100 and 102, respectively. As previously mentioned, the gravure cylinder 14 illustrated in FIG. 1 is the most flexible cylinder to be used in the press 12; therefore, the ends 92 and 94 of the screws 88 and 90 do not make contact with the leaf springs 76 and 78 and no pressure is exerted upon pressure ridges 100 and 102 by the springs 76 and 78. Uniform pressure across the face width 46 of the impression roll 10 on the cylinder 14 is obtained as follows: Calculations are made by methods described in the book entitled, "Formulas for Stress and Strain", Fifth Edition by R. J. Roark and W. C. Young, McGraw-Hill, Inc. 1975, International Standard Book Number 0-07-053031-9, or measurements are made on a stopped press using conventional devices such as a machinist's straight edge and feeler gauges to determine the difference in the downward deflection of the most flexible gravure cylinder 14 between the surface of the gravure cylinder 14 at its transverse center 108 and the ends 107 and 109 of the impression at a standard applied impression pressure e.g., 100 pli (pounds per linear inch) across the face width 46 of the impression roll 10. The main bearings 50 and 52 are axially located at predetermined distances 110 and 112 from the ends 42 and 44, respectively, of the impression roll 10, so that the downward deflection of the shell 37 of the impression roll 10 at its transverse center 114 is equal to the downward deflection of the surface of the gravure cylinder 14 at its transverse center 108.

To accomplish this, the right and left half of the impression roll shell 37 may be considered cantilevers rigidly anchored at the center 114 with ends 42 and 44 deflected upward due to the standardized impression roll pressure of 100 pli. Superimposed on the upward deflection of the ends 42 and 44 is the downward deflection due to the forces applied by the main bearings 50 and 52 located at distances 110 and 112 from the ends 42 and 44, respectively. The formulas for calculating the deflections of the cantilevers under concentrated and distributed loads are found on pages 96 and 98 of the aforementioned book entitled, "Formulas for Stress and Strain."

Using a few trial values for the distances 110 and 112, the proper distances can be determined so that the upward deflection of the ends 42 and 44 of the impression roll 10 is equal to the downward deflection of the surface of the gravure cylinder 14 at its transverse center 108 for the most flexible gravure cylinder 14 over the face width 46 of the impression roll 10. In accordance therewith, the lengths 110 and 112, as measured from the ends 42 and 44, will be in the range of about 28% to about 36% of face width 46 of the impression roll 10. Disregarding the very small deflection of the gravure cylinder 14 as a result of its own weight and in view of the fact that the impression pressure exerted by the impression roll 10 on the gravure cylinder 14 will always be the same as the reaction exerted by the gravure cylinder 14 on the impression roll 10 regardless of the amount of pressure that is applied, it is apparent that if the deflections of the gravure cylinder 14 and impression roll 10 equal each other at one applied pressure they will be equal regardless of the amount of impression pressure that is applied, and the impression pressure will be uniform over the face width 46 of the impression roll 10.

As seen in FIG. 1, when the most flexible gravure cylinder 14 is used in the press 12, the adjustment screws 88 and 90 do not engage springs 76 and 78 and, therefore, no force is exerted against pressure ridges 100 and 102. Thus, no pressure is exerted on the impression roll shell 37 by the outside bearings 84 and 86. However, when a gravure cylinder 116 of larger diameter and high bending strength is utilized, as illustrated in FIG. 2, the transverse center 113 of this gravure cylinder 116 will deflect less in the downward direction than the transverse center 108 of the most flexible gravure cylinder 14. Since the main bearings 50 and 52 were positioned to provide a downward deflection of the transverse center 114 of the impression roll 10 equal to the downward deflection of the transverse center 108 of the most flexible gravure cylinder 14, the impression pressure at the transverse center of the gravure cylinder would be higher than that at the ends when a gravure cylinder of larger diameter and higher bending strength is utilized. In order to overcome this result and achieve uniform pressure, some of the forces exerted by the main bearings 50 and 52 on the impression roll shell 37 are shifted to the outer bearings 54 and 56. To accomplish this and obtain uniform pressure, the adjustment screws 88 and 90 are advanced downwardly in tapped holes 117 and 119 in the non-rotating beam 48 so that the ends 92 and 94 engage the leaf springs 76 and 78, respectively, which in turn exert a downward force on the pressure ridges 100 and 102, when pressure is applied to the beam 48 thereby causing the end bearings 54 and 56 to push the impression roll shell 37 downward near the ends 42 and 44 of the impression roll 10.

The correct amount of advancement of the screws 88 and 90 for a cylinder 116 having a given bending stiffness can be determined, e.g., by the application of grease or stamp pad ink to the cylinder or impression roll and observing the width of the "impression flat" after the impression pressure is applied and the impression roll 10 is removed from engagement with the gravure cylinder with the press de-energized. Alternatively, the correct amount of advancement of the screws 88 and 90 can be determined by checking the amount of deflection of the impression roll 10 and gravure cylinder 116 by using a machinist's straight edge and feeler gauges or by similar means commonly used in gravure press-room practice.

The bending stiffness of a beam is strongly dependent on its outside dimension, e.g., the bending stiffness of a circular shaft increases with the fourth power of the diameter. Therefore, the downward deflection of the ends 58 and 60 of beam 48 in FIGS. 1 and 2 is substantially larger than the desired downward deflection of the impression roll shell 37. The deflection of the impression roll shell 37 will be at most on the order of 0.020 inches whereas the ends 58 and 60 of beam 48 might bend downward as mush as 0.125 to 0.250 inches in relation to the shell 37. The interposition of the spring members 76 and 78 between the ends 92 and 94 of screws 88 and 90, respectively, provides a cushion for absorbing this difference in deflection and causes the forces that are exerted on the pressure ridges 100 and 102 to be proportional to the deflection of the ends 58 and 60 of beam 48, which deflection is also proportional to the applied impression pressure. The error in the linear relationship between the applied impression pressure and the force that is applied to the pressure ridges 100 and 102 due to preloading or non-contact between screws 88 and 90, spring members 76 and 78 and pressure ridges 100 and 102 is so small, that no adjustments in the position of the screws 88 and 90 are required when the impression pressure is changed.

Figure 3:
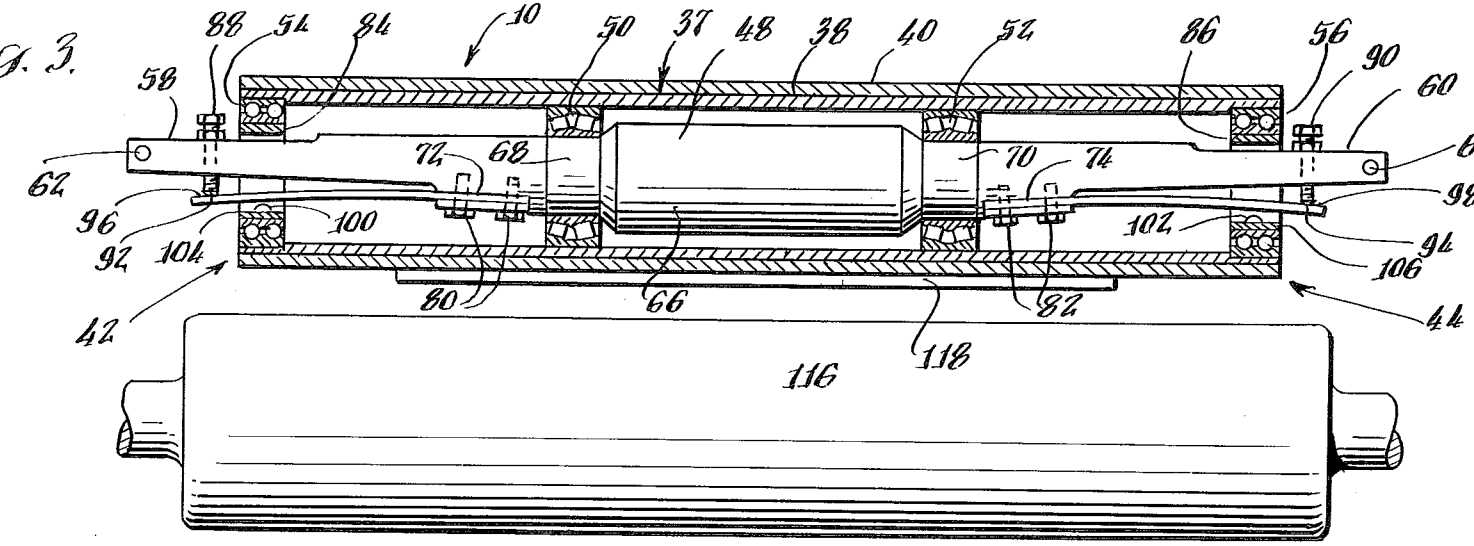
FIG. 3 is a side elevational view in partial section of a deflection compensating impression roll in accordance with the present invention removed from pressure contact with the gravure cylinder shown in FIG. 2.

Referring to FIG. 3, when the impression roll 10 is lifted off or removed from pressure contact with the gravure cylinder 10, to pass a web 118 between the impression roll and the gravure cylinder 116, the impression roll 10 should turn freely to avoid tearing the unsupported web 118 and to prevent the web 118 from sliding on the surface of the elastomeric impression roll 10 and thereby producing static electricity, which is undesirable on presses using flammable ink solvents. Free turning of the impression roll 10 is accomplished in accordance with the present invention by utilizing the reversal of the downward bending of the ends 58 and 60 of beam 48 when the impression roll 10 is lifted off the gravure cylinder 116. This effect can be readily seen by a comparison of FIGS. 2 and 3. With the screws 88 and 90 advanced by the same amount through beam 116 as in FIG. 2, the spring members 76 and 78 do not make contact or make at most only light contact with the pressure ridges 100 and 102 when the impression roll 10 is removed from pressure contact with the gravure cylinder 116 as shown in FIG. 3. This effect is achieved by making the ends 58 and 60 of beam 48 flexible enough so that they will bend down in relation to the impression roll shell 37 by about 0.125 to about 0.250 inches when normal impression pressures are applied, and allow beam 48 to straighten out when the impression roll 10 is removed from pressure contact with the gravure cylinder 116.

Figure 4:
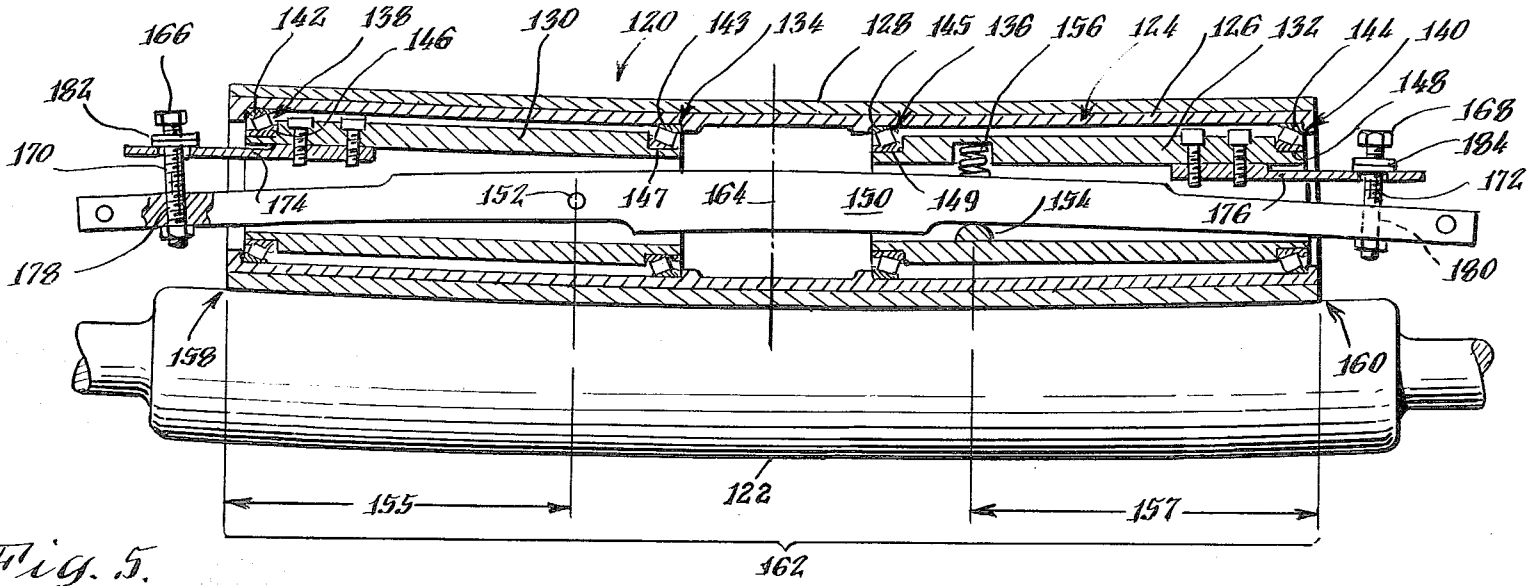
FIG. 4 is a side elevational view in partial section of another embodiment of a deflection compensating impression roll in accordance with the present invention shown in use with the most flexible gravure cylinder to be used in a gravure press.

Referring to FIG. 4, another embodiment of the present invention is illustrated which facilitates assembly and disassembly of an impression roll 120. The impression roll 120 is pressed against a gravure cylinder 122 by conventional means (not shown) such as illustrated in FIG. 1. The impression roll 120 includes a shell 124 having a tubular metal sleeve 126 and an elastomeric covering 128. The shell 124 is supported on non-rotating tubular metal sleeves 130 and 132 by two sets of bearings, main bearings 134 and 136, and end bearings 138 and 140. For ease of assembly, and in view of the fact that with bearings whose outer races rotate the outer races 142 and 144 of the end bearing 138 and 140 and outer races 143 and 145 of the main bearings 134 and 136 should be firmly pressed into the impression roll shell 124, preferably bearings where the roller cage and inner races 146 and 148, and 147 and 149 can be readily removed from the outer races 142 and 144, and 143 and 145, such as certain cylindrical or tapered roller bearings, are utilized. Such bearings require more accurate alignment than self-aligning spherical roller bearings. However, this can be readily accomplished in the embodiment shown in FIG. 4, because the inner races 147 and 149 of the main bearings 134 and 136 are not located on the non-rotating beam 150, which is subject to its maximum bending moment near the center of the press.

Tubular sleeve 130 is located on the beam 150 by a horizontal pin 152 so that forces can be transmitted from the beam 150 to the tubular sleeve 130. It is not practical to use another pin to locate tubular sleeve 132 on the beam 150 because during assembly such a pin would have to be installed with tubular sleeve 132 located inside of the shell 124. Therefore, pressure ridge 154 is affixed to the interior of the tubular sleeve 132 to permit the transmission of forces from beam 150 to the tubular sleeve 132. A spring 156 applies a biasing force on the top side of beam 150 to maintain contact between pressure ridge 154 and beam 150 when the impression roll 120 is removed from pressure contact with cylinder 122, thereby keeping the impression roll 120 horizontal during insertion of a web.

The pin 152 and the pressure ridge 145 are located the same distance from the ends 158 and 160 of the impression roll 120 as was described with reference to the main bearings 50 and 52 in FIG. 1. The main bearings 134 and 136 in FIG. 4 are then located a distance equal to about 5 to about 10 percent of the impression roll face width 162 and extending from pin 152 and the pressure ridge 154 toward the center 164 of the impression roll 120.

As seen in FIG. 4, the heads 166 and 168 of adjustable screws 170 and 172, respectively, do not exert any downward pull on spring members 174 and 176, so that the resultants of the downward forces exerted on the impression roll shell 124 will be located at pin 152 and pressure ridge 154, respectively. Therefore, the impression pressure will be uniform over the face width 162 of the impression roll 120 when the most flexible cylinder that is to be used is installed in the gravure press.

When a gravure cylinder of higher bending strength is used, adjustable screws 170 and 172 are turned down into threaded holes 178 and 180 of beam 150 until spring members 174 and 176 exert a sufficient downward pull on sleeves 130 and 132 to provide a uniform impression pressure across the width of the impression roll face 162. To verify that a uniform impression pressure condition has been established, an impression flat measurement may be made, or a straight edge and feeler gauges may be used as previously described.

To provide firm and square seating of the heads 166 and 168 of screws 178 and 180, when downward forces are exerted on spring members 174 and 176, sets of conventional spherical or self-aligning washers 182 and 184 may be used. Moreover, conventional short and stiff compression springs with squared off ends can be used between screw heads 166 and 168 and washers 182 and 184, respectively, when a greater cushioning effect is desired. Such self-aligning washers and compression springs can be readily obtained from tool maker supply houses.

Figure 5:
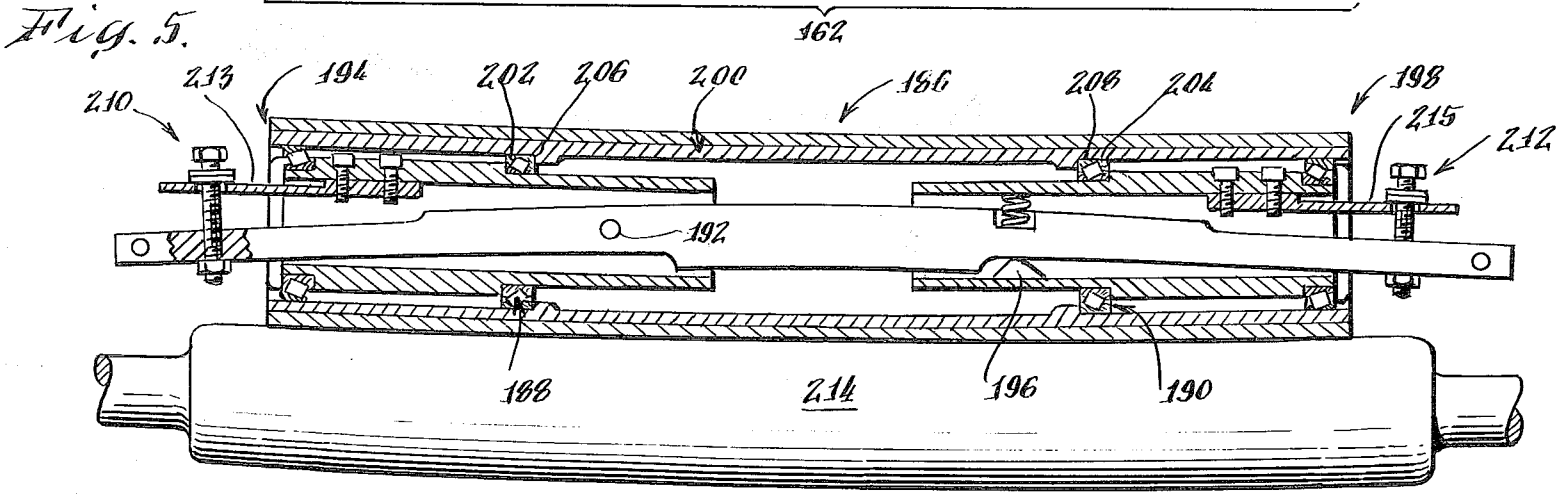
FIG. 5 is a side elevational view in partial section of another embodiment of a deflection compensating impression roll in accordance with the present invention shown in use with the most flexible gravure cylinder to be used in a gravure press.

Referring to FIG. 5, another embodiment of the present invention is illustrated. In contrast to the construction of the impression roll 120 of FIG. 4, the impression roll 186 of FIG. 5 has the main bearings 188 and 190 located on the opposite side of pin 192 toward the end 194 and the opposite side of the presssure ridge 196 toward the end 198. The pin 192 and pressure ridge 196 are located at a distance of from about 24 to about 32% of the face width of the impression roll 186 as measured from the ends 194 and 198, respectively. The main bearings 188 and 190 are located at a distance of from about 5 to about 10% of the face width of the impression roll 186 as measured from the pin 192 and pressure ridge 196 toward the ends 194 and 198, respectively, of the pressure roll 186. This arrangement offers the advantage that the main bearings 188 and 190 are located closer to the ends 194 and 198 of the shell 200 of the impression roll 186, which facilitates the accurate machining of the seats 202 and 204 for the outer races 206 and 208 of main bearings 188 and 190 in the impression roll shell 200. Moreover, with this arrangement, the ends 194 and 198 of the impression roll 186 are actually forced upward unless downward pressure is exerted thereon by screws 210 and 212 and springs 213 and 215. Therefore, this embodiment facilitates the use of the impression roll 186 with a relatively flexible gravure cylinder 214 having relatively little resistance to bending. These advantages have to be balanced against the possible disadvantage of having greater loads on the main bearings 188 and 190 than the impression forces that are applied at pin 192 and pressure ridge 196.

In accordance with the present invention, an impression roll shell produces a uniform impression pressure when the impression roll is used with the most flexible gravure cylinder with which it is anticipated ever to be used, and the ends of the impression roll are pushed or pulled downwardly when a less flexible gravure cylinder is used by using the downward deflection or bending of the ends of the shaft of the impression roll, which downward deflection is proportional to the impression pressure, to increase the downward forces at the ends of the impression roll in proportion to the impression pressure, whereby the need to make adjustments whenever the impression pressure is changed is avoided. Moreover, the reversal of the relatively large deflections of the ends of the impression roll shaft under impression pressure are utilized to remove most or all of the load from the bearings when the impression roll is removed from pressure contact with the ground cylinder, thereby facilitating free turning of the impression roll during loading of the web.

It should be understood by those skilled in the art that various modifications may be made in the present invention without departing from the spirit and scope thereof, as described in the specification and defined in the appended claims. For example, the adjustment screws may be replaced by cams or eccentrics that are self-locking or lockable, or by pneumatic or hydraulic cylinders, as desired. It should also be understood, that although the present invention was described herein for use with gravure cylinders, there are many other applications, specifically in the field of printing, coating, laminating, and paper, film and foil converting, where uniform pressure between two parallel counter rollers is desirable and where the apparatus of the present invention will be useful.

What is claimed is:

1. A system for compensating for roll deflection to provide uniform contact pressure across the width of a web disposed between a pair of counter rollers, comprising:

a first roller mounted for rotation;

a second roller mounted for rotation about a deflectable shaft;

pressure applying means coupled to the ends of said deflectable shaft for moving said second roller into contact with said first roller;

said second roller including an outer shell mounted for rotation relative to said deflectable shaft;

a pair of end bearings disposed adjacent the ends of said outer sleeve and a pair of main bearings disposed inwardly from said end bearings a predetermined distance to transmit the applied pressure uniformly over the face width of said second roller when said second roller is used with a flexible first roller;

self-adjusting deflection compensating means arranged proximate to said deflectable shaft for applying pressure to the ends of said outer shell in response to the deflection of said deflectable shaft by said pressure applying means to provide uniform pressure across the face width of said second roller when said second roller is used with a first roller having a high resistance to bending said self-adjusting deflection compensating means including spring means coupled proximate to each end of said second roller internally thereof; and adjustable spring engagement means for deflecting said spring means to adjust the pressure applied to the ends of said second roller; said self-adjusting deflection compensating means applying a downward force to the ends of said second roller when said deflectable shaft is deflected downwardly a predetermined distance.

2. The system recited in claim 1, wherein:

said adjustable spring engagement means includes adjustable linkage means.

3. The system recited in claim 2, wherein:

said linkage means includes adjustable screw means.

4. The system recited in claim 2, wherein:

said spring means is mechanically coupled to said linkage means.

5. The system recited in claim 4, wherein:

said self-adjusting deflection compensating means includes pressure ridges mechanically coupled to said end bearings for applying a force to the ends of said outer shell when said spring means is placed in pressure contact with said pressure ridges by said linkage means.

6. The system recited in claim 1, wherein:

said main bearings are located at a distance of from about 28 to about 36% of the face width of said second roller from the ends of said second roller toward the center thereof and support said outer sleeve for rotation about said deflectable shaft.

7. The system recited in claim 1, wherein:

deactivation of said pressure applying means enables said deflectable shaft to return to a horizontal position preventing the application of pressure to the ends of the outer shell.

8. The system recited in claim 1, including:

intermediate sleeve means for supporting said outer shell for rotation about said main and end bearings;

means interconnecting said intermediate sleeve means to said deflectable shaft;

a pressure ridge affixed to said intermediate sleeve means for engagement by said deflectable shaft.

9. The system recited in claim 8, wherein:

said interconnecting means and said pressure ridge are located at a distance of from about 28 to about 36% of the face width of said second roller from the ends of said second roller toward the center thereof;

said main bearings are located at a distance of from about 5 to about 10% of the face width of said second roller from said interconnecting means and said pressure ridge toward the center of said second roller.

10. The system recited in claim 8, including:

biasing means for maintaining contact between said deflectable shaft and said pressure ridge when said second roller is removed from pressure engagement with said first roller to maintain said second roller in a horizontal position.

11. The system recited in claim 8, wherein:

said adjustable spring engagement means includes linkage means interconnecting said intermediate sleeve means to said deflectable shaft.

12. The system recited in claim 11, wherein:

said linkage means includes adjustable screws coupled to said deflectable shaft.

13. The system recited in claim 8, wherein:

said interconnecting means and said pressure ridge are located at a distance of from about 24 to about 32% of the face width of said second roller from the ends of said second roller toward the center thereof;

said main bearings are located at a distance of from about 5 to about 10% of the face width of said second roller from said interconnecting means and pressure ridge toward the ends of said second roller.

14. The system recited in claim 1, wherein:

said first roller is a gravure cylinder;

said second roller is an impression roller having an elastomeric covering extending over said outer shell.

15. The system recited in claim 1, wherein:

said main pair of bearings are anti-friction self-aligning roller bearings;

said end pair of bearings are anti-friction bearings.

16. The system recited in claim 1, wherein:

said bearings are cylindrical or tapered roller bearings.

17. A system for compensating for deflection of a gravure cylinder to provide uniform contact pressure across the width of a web disposed between an impression roll and a gravure cylinder, comprising:

a gravure cylinder mounted for rotation;

an impression roll having a deflectable central beam and an outer shell journalled for rotation relative to said central beam;

means coupled to the ends of said deflectable central beam for moving said impression roll into pressure contact with said gravure cylinder;

a pair of main bearings disposed near the center of said outer shell to transmit the applied load uniformly over the face width of said impression roll when said impression roll is used with a flexible gravure cylinder;

a pair of end bearings arranged near the ends of said impression roll;

self-adjusting deflection force applying means arranged proximate to the ends of said deflectable central beam for coacting with the ends of said outer shell for applying pressure thereto in response to a predetermined deflection of said deflectable central beam caused by said moving means thereby providing a uniform pressure across the face width of said impression roll when said impression roll is placed in pressure contact with a gravure cylinder having a high resistance to bending and removing any pressure from the ends of said outer shell when said moving means removes said impression roll from pressure contact with said gravure cylinder; said self-adjusting deflection force applying means including spring means coupled proximate to each end of said impression roll internally thereof; and adjustable spring engagement means for deflecting said spring means to adjust the pressure applied to the ends of said impression roll; said self-adjusting deflection force applying means applying a downward force to the ends of said impression roll when said deflectable central beam is deflected downwardly a predetermined distance.

18. The system recited in claim 17, wherein:

said self-adjusting deflection force applying means includes pressure ridges mechanically coupled to said end bearings and said spring means applies a force to said pressure ridges and thus the ends of said outer shell when said spring means is placed in pressure contact with said pressure ridges by the deflection of said deflectable central beam.

19. The system recited in claim 18 wherein:

said main bearings are located at a distance of from about 28 to about 36% of the width of said impression roll from the ends of said impression roll toward the center thereof.

20. The system recited in claim 17, including:

intermediate sleeve means for supporting said outer shell for rotation about said main bearings;

means interconnecting said intermediate sleeve means to said deflectable central beam; and a pressure ridge affixed to said intermediate sleeve means for engagement by said deflectable central beam.

21. The system recited in claim 20, wherein:

said interconnecting means and said pressure ridge are located at a distance of from about 28 to about 36% of the face width of said impression roll from the ends of said impression roll toward the center thereof;

said main bearings are located at a distance of from about 5 to about 10% of the face width of said impression roll from said interconnecting means and said pressure ridge toward the center of said second roller.

22. The system recited in claim 20, including:

biasing means for maintaining contact between said deflectable central beam and said pressure ridge when said impression roll is removed from pressure contact with said gravure cylinder to maintain said impression roll in a horizontal position.

23. The system recited in claim 20, wherein:

said spring means interconnects said intermediate sleeve means to said deflectable central beam to apply a force to the ends of said outer shell when said deflectable central beam is deflected downwardly.

24. The system recited in claim 20, wherein:

said interconnecting means and said pressure ridge are located at a distance of from about 24 to about 32% of the face width of said impression roll from the ends of said impression roll toward the center thereof;

said main bearings are located at a distance of from about 5 to about 10% of the face width of said impression roll from said interconnecting means and pressure ridge toward the ends of said impression roll.

25. A deflection compensating impression roll having a deflectable central core and outer shell mounted for rotation about the central core for use with a gravure cylinder to apply pressure to a web interposed between the impression roll and gravure cylinder for ink transfer from the gravure cylinder to the web, wherein the improvement comprises:

a pair of main bearings extending inwardly from the ends of the impression roll a predetermined distance so that when the impression roll is used under load with the most flexible gravure cylinder with which the impression roll is to be used, the ends of the impression roll will deflect upwardly an amount equal to the downward deflection of the center of the gravure cylinder to provide uniform pressure across the face width of the impression roll;

a pair of end bearings arranged adjacent the ends of the outer shell; and self-adjusting deflection compensating means responsive to the downward deflection of said deflectable central core to apply a downward force to the ends of the impression roll when the impression roll is used under pressure with a gravure cylinder of high bending strength to provide uniform pressure across the face width of the impression roll; said self-adjusting deflection compensating means including spring means coupled proximate to each end of said impression roll internally thereof; and adjustable spring engagement means for deflecting said spring means to adjust the pressure applied to the ends of said impression roll; said self-adjusting deflection compensating means applying a downward force to the ends of said impression roll when said deflectable central core is deflected downwardly a predetermined distance.

26. The deflection compensating impression roll recited in claim 25, wherein:

said pair of main bearings are located at a distance of from 28 to about 36% of the face width of the impression roll from the ends of the impression roll toward the center thereof.

27. The deflection compensating impression roll recited in claim 25, wherein:

said self-adjusting deflection compensating means is deactivated when the impression roll is removed from pressure contact with the gravure cylinder.

28. The deflection compensating impression roll recited in claim 25, including:

said self-adjusting deflection compensating means including pressure ridges mechanically coupled to the interior of said end bearings, said spring means including a pair of springs affixed at one end to the deflectable central core and overlying said pressure ridges, and wherein said adjustable spring engagement means deflects said springs into pressure contact with said pressure ridges.

29. The deflection compensating impression roll recited in claim 25, including:

intermediate sleeve means for supporting the outer shell for rotation on said main bearings;

means interconnecting said intermediate sleeve means to said deflectable central core;

a pressure ridge affixed to said intermediate sleeve means for engagement by said deflectable central core.

30. The deflection compensating impression roll recited in claim 29, wherein:

said interconnecting means and said pressure ridge are located at a distance of from about 28 to about 36% of the face width of the impression roll from the ends thereof toward the center;

said pair of main bearings are located a distance of from about 5 to about 10% of the face width of said impression roll from said interconnecting means and said pressure ridge toward the center of the impression roll.

31. The deflection compensating impression roll recited in claim 29, including:

bias means for maintaining contact between said deflectable central core and said pressure ridge when the impression roll is removed from pressure contact with the gravure cylinder to maintain the impression roll in a horizontal position.

32. The deflection compensating impression roll recited in claim 29, wherein:

said adjustable spring engagement means includes linkage means interconnecting said intermediate sleeve means to said deflectable central core.

33. The deflection compensating impression roll recited in claim 32, wherein:

said linkage means includes adjustment screws coupled to the deflectable central core.

34. The deflection compensating impression roll recited in claim 29, wherein:

said interconnecting means and said pressure ridge are located at a distance of from about 24 to about 32% of the face width of the impression roll from the ends of the impression roll toward the center thereof;

said pair of main bearings are located at a distance of from about 5 to about 10% of the face width of the impression roll from said interconnecting means and pressure transmitting means toward the ends of the impression roll.

35. The deflection compensating impression roll recited in claim 25, wherein:

said main bearings are anti-friction self-aligning roller bearings.

36. The deflection compensating impression roll recited in claim 29, wherein:

said bearings are anti-friction cylinderical or tapered roller bearings.

37. A deflection compensating impression roll having a deflectable central core and outer shell mounted for rotation about the central core for use with a gravure cylinder to apply pressure to a web interposed between the impression roll and gravure cylinder for ink transfer from the gravure cylinder to the web, wherein the improvement comprises:

a pair of main bearings extending inwardly from the ends of the impression roll a predetermined distance so that when the impression roll is used under applied pressure with the most flexible gravure cylinder with which the impression roll is to be used, the ends of the impression roll will deflect upwardly an amount equal to the downward deflection of the center of the impression roll to provide uniform pressure across the face width of the impression roll;

force transmitting means responsive to the downward deflection of said deflectable central core to apply a downward force to the ends of the impression roll when the impression roll is used under applied pressure with a gravure cylinder of high bending strength to provide uniform pressure across the face width of the impression roll;

said pair of main bearings are located at a distance of from 28 to about 36% of the face width of the impression roll from the ends of the impression roll toward the center thereof;

said force transmitting means is deactivated when the impression roll is removed from pressure contact with the gravure cylinder; and said force transmitting means includes pressure ridges mechanically coupled to the interior of bearings arranged at the ends of the outer shell, a pair of springs affixed at one end to the deflectable central core and overlying said pressure ridges, and adjustable spring engagement means for deflecting said springs into pressure contact with said pressure ridges to applying a downward force to the ends of the impression roll when the deflectable central core is deflected downwardly a predetermined distance.

38. A deflection compensating impression roll having a deflectable central core and outer shell mounted for rotation about the central core for use with a gravure cylinder to apply pressure to a web interposed between the impression roll and gravure cylinder for ink transfer from the gravure cylinder to the web, wherein the improvement comprises:

a pair of main bearings extending inwardly from the ends of the impression roll a predetermined distance so that when the impression roll is used under applied pressure with the most flexible gravure cylinder with which the impression roll is to be used, the ends of the impression roll will deflect upwardly an amount equal to the downward deflection of the center of the impression roll to provide uniform pressure across the face width of the impression roll;

force coupling means responsive to the downward deflection of said deflectable central core for applying a downward force to the ends of the impression roll when the impression roll is used under applied pressure with a gravure cylinder of high bending strength to provide uniform pressure across the face width of the impression roll;

intermediate sleeve means for supporting the outer shell for rotation about said pair of main bearings;

means interconnecting said intermediate sleeve means to said deflectable central core;

a pressure ridge affixed to said intermediate sleeve means for engagement by said deflectable central core;

said interconnecting means and said pressure ridge are located at a distance of from about 28 to about 36% of the face width of the impression roll from the ends thereof toward the center;

said pair of main bearings are located a distance of from about 5 to about 10% of the width of said impression roll from said interconnecting means and said pressure ridge toward the center of the impression roll;

biasing means for maintaining contact between said deflectable central core and said pressure ridge when the impression roll is removed from pressure engagement with the gravure cylinder to maintain the impression roll in a horizontal position;

said force coupling means including spring means interconnecting said intermediate sleeve means to said deflectable central core to apply a downward force to the ends of the outer shell when the deflectable central core deflects downwardly, and adjustable linkage means for coupling said spring means to the deflectable central core.

39. A deflection compensating impression roll having a deflectable central core and outer shell mounted for rotation about the central core for use with a gravure cylinder to apply pressure to a web interposed between the impression roll and gravure cylinder for ink transfer from the gravure cylinder to the web, wherein the improvement comprises:

a pair of main bearings extending inwardly from the ends of the impression roll a predetermined distance so that when the impression roll is used under applied pressure with the most flexible gravure cylinder with which the impression roll is to be used, the ends of the impression roll will deflect inwardly an amount equal to the downward deflection of the center of the impression roll to provide uniform pressure across the face width of the impression roll;

force coupling means responsive to the downward deflection of said deflectable central core for applying a downward force to the ends of the impression roll when the impression roll is used under applied pressure with a gravure cylinder of high bending strength to provide uniform pressure across the face width of the impression roll;

intermediate sleeve means for supporting the outer shell for rotation about said pair of main bearings;

means interconnecting said intermediate sleeve means to said deflectable central core;

a pressure ridge affixed to said intermediate sleeve means for engagement by said deflectable central core;

biasing means for maintaining contact between said deflectable central core and said pressure ridge when the impression roll is removed from pressure engagement with the gravure cylinder to maintain the impression roll in a horizontal position;

said force coupling means including spring means interconnecting said intermediate sleeve means to said deflectable central core for applying a downward force to the ends of the outer shell when the deflectable central core deflects downwardly, and adjustable linkage means for coupling said spring means to said deflectable core;

said interconnecting means and said pressure ridge are located at a distance of from about 24 to about 32% of the face width of the impression roll from the ends of the impression roll toward the center thereof; and said pair of main bearings are located at a distance of from about 5 to about 10% of the face width of the impression roll from said interconnecting means and said pressure ridge toward the ends of the impression roll.

* * * * *